US008430134B2

(12) United States Patent
Gill

(10) Patent No.: US 8,430,134 B2
(45) Date of Patent: Apr. 30, 2013

(54) UNIVERSAL ADAPTER FOR LIQUID TRANSFER

(75) Inventor: Yoram Gill, Haifa (IL)

(73) Assignee: Source Vagabond Systems Ltd., Tirat Carmel (IL)

( * ) Notice: Subject to any disclaimer, the term of this patent is extended or adjusted under 35 U.S.C. 154(b) by 785 days.

(21) Appl. No.: 12/619,064

(22) Filed: Nov. 16, 2009

(65) Prior Publication Data

US 2011/0114220 A1 May 19, 2011

(51) Int. Cl.
*B65B 3/00* (2006.01)

(52) U.S. Cl.
USPC ..... 141/18; 141/309; 141/383; 141/391

(58) Field of Classification Search ..... 141/18, 141/309, 382, 383, 384, 391
See application file for complete search history.

(56) References Cited

U.S. PATENT DOCUMENTS 4,313,477 A * 2/1982 Sebalos ..... 141/301
4,458,711 A 7/1984 Flider
5,474,112 A * 12/1995 Carola ..... 141/7
5,534,228 A * 7/1996 Wesseler ..... 422/541
6,247,619 B1 * 6/2001 Gill et al. ..... 222/105
6,453,940 B1 9/2002 Tipton et al.
6,945,417 B2 * 9/2005 Jansen et al. ..... 141/329
8,251,110 B2 * 8/2012 Bassett et al. ..... 141/319
2004/0060598 A1 4/2004 Danby et al.
2007/0131725 A1 6/2007 Friedman
2008/0277433 A1 11/2008 Karl et al.

OTHER PUBLICATIONS

International Search Report for PCT Application No. PCT/IL10/00782 mailed on Feb. 8, 2011.

* cited by examiner

*Primary Examiner* — Gregory Huson
*Assistant Examiner* — Nicolas A Arnett
(74) *Attorney, Agent, or Firm* — Pearl Cohen Zedek Latzer, LLP

(57) ABSTRACT

A universal adapter device facilitates transfer of liquid from a neck of a liquid dispenser to a receiving container. The device includes a hollow body. The hollow body includes a flexible liquid inlet with an inwardly sloping flexible collar, a liquid outlet, and a one-way valve for allowing air into the hollow body when a pressure within the hollow body is less than ambient pressure.

11 Claims, 4 Drawing Sheets

UNIVERSAL ADAPTER FOR LIQUID TRANSFER

FIELD OF THE INVENTION

The present invention relates to transfer of liquid to a container. More particularly, the present invention relates to a universal adapter for transferring liquid from different liquid sources.

BACKGROUND OF THE INVENTION

A hydration system is a portable liquid container system designed to enable a user engaged in an outdoor activity, for example, a sport, to drink as needed while on the move. The system is designed to operate with minimal use of the user's hands. For example, a hydration system may include a flexible bag or bladder made of a material impermeable to liquids. The flexible bladder may be designed to be worn by the user, for example, by being strapped to the user's back or arm. Alternatively, the bladder may be mounted on other gear, such as a backpack or other carrier that is carried without the use of hands. The hydration system enables a user to drink from a liquid in the bladder through a drinking hose that extends from the system to the user's mouth. One end of the drinking hose attaches to a suitable connector on the bladder. The other free end of the drinking hose typically is provided with a drinking valve. The drinking valve typically is self sealing. Thus, when not being used to drink, the drinking valve seals the drinking hose. When wishing to drink, a user may bite on the valve, or perform another similar hands-free operation, to open the drinking valve and drink through the drinking hose.

The bladder of a hydration system is generally provided with a sealable opening through which the bladder may be filled from a source of liquid. However, filling the bladder through such an opening typically requires removing the bladder, for example, by undoing any straps holding the bladder to the user's body. The bladder filler port must then be supported under a liquid dispenser, such as a water tap, or the mouth of a bottle containing refilling liquid, while the bladder is being re-filled.

In order to avoid the inconvenience and delay involved in removing the bladder every time a user needs to re-fill it, a hydration system may be provided with a filling adapter. The filling adapter enables filling the bladder, for example through its drinking hose, while leaving the bladder in place. For example, a filling adapter may be designed to temporarily replace the drinking valve at the end of the drinking hose. In order to fill the bag using a filling adapter, a user may, for example, detach the drinking valve from the drinking hose and attach the filling adapter in its place. The drinking hose may be provided with a valve that may be closed to prevent liquid contents of the bag from spilling out when the drinking valve is removed.

For a typical hydration system, a filling adapter is designed either to fit over a specific fixture or liquid dispenser neck, such as, for example, a particular water tap design or type of bottle mouth. A user may select an appropriate filling adapter on the basis of the type of liquid dispenser that is available. Thus use of an adapter may be limited to a particular liquid dispenser, or to a liquid dispenser with an opening of a particular size.

Another problem arises when using existing filling adapters to fill the hydration system from a rigid or semi-rigid bottle. In general, in order to enable a liquid to flow freely from a bottle as the bottle is emptied, air must be allowed into the bottle to replace the volume vacated by the removed liquid. If the volume of removed liquid is not replaced with air, the atmospheric pressure outside the bottle may tend to resist the flow of liquid from the bottle into the hydration system. In the case of filling from a flexible or crushable bottle, the bottle may require squeezing or crushing as it is emptied in order to facilitate transfer of the liquid. However, the design goal in hydration systems is generally to enable operation that is as hands-free as possible. In the case of filling from a rigid bottle, squeezing the bottle may not be possible.

Thus, there is a need for a filling adapter for a hydration system that may be used with a variety of liquid dispensers, and that enables operation with one hand during most stages of the filling.

It is an object of the present invention to provide a filling adapter that is adaptable to a wide range of diameters of liquid dispenser necks, and that may be used easily even when filling from rigid bottles.

Other aims and advantages of the present invention will become apparent after reading the present invention and reviewing the accompanying drawings.

SUMMARY OF THE INVENTION

There is thus provided, in accordance with some embodiments of the present invention, a universal adapter device for facilitating transfer of liquid from a neck of a liquid dispenser to a receiving container. The device comprises a hollow body that includes: a flexible liquid inlet with an inwardly sloping flexible collar, a liquid outlet, and a one-way valve for allowing air into the hollow body when a pressure within the hollow body is less than ambient pressure.

Furthermore, in accordance with some embodiments of the present invention, the device includes a barrier between the one-way valve and the liquid outlet for directing air bubbles formed by air entering through the one-way valve away from the outlet.

Furthermore, in accordance with some embodiments of the present invention, the device includes a connector for connecting the outlet to the receiving container.

Furthermore, in accordance with some embodiments of the present invention, the one-way valve comprises a flapper valve.

Furthermore, in accordance with some embodiments of the present invention, the flapper valve comprises an umbrella valve.

Furthermore, in accordance with some embodiments of the present invention, the body includes a rigid plate on which the outlet and the one-way valve are located, and a flexible sleeve.

Furthermore, in accordance with some embodiments of the present invention, the hollow body includes a ragged outer surface.

Furthermore, in accordance with some embodiments of the present invention, the ragged outer surface includes ribs.

Furthermore, in accordance with some embodiments of the present invention, the hollow body includes an indented waist.

Furthermore, in accordance with some embodiments of the present invention, the device is made from materials selected from the group of materials consisting of: synthetic rubber, natural rubber, and thermoplastic elastomer.

Furthermore, in accordance with some embodiments of the present invention, the liquid inlet is circular.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF EMBODIMENTS

Figure 1:
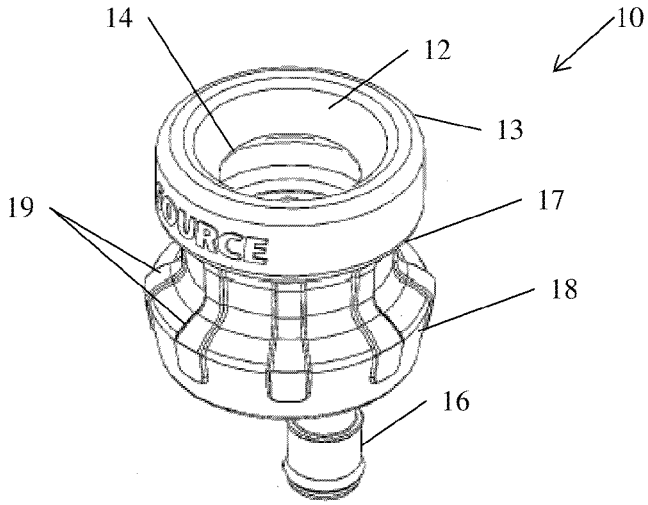
FIG. 1 is a perspective view of a universal adapter in accordance with some embodiments of the present invention, showing the liquid inlet.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

A universal adapter in accordance with embodiments of the present invention includes a hollow body with a liquid inlet at one end and a liquid outlet connector at another end. The liquid inlet is designed to fit over a neck of any commonly found liquid dispenser. The liquid inlet may be fit over the neck of a pressurized liquid dispenser, such as a water tap fed by a water main, or a container from which liquid empties under the force of gravity. For example, a commonly found liquid dispenser neck may include any of a number of standard sized home water taps, garden taps, or field taps, or any of a number of standard sized bottle mouths, such as of mineral water bottles. The liquid dispenser may dispense its liquid contents through the neck. Fitting the liquid inlet over the liquid dispenser neck may enable liquid to flow from the liquid dispenser neck into the universal adapter with little or no spillage. The adapter is referred to as universal in that the liquid inlet is designed to fit over necks within a range of sizes. Typically, the universal adapter may be designed to fit over any neck that a user, or class of user, is likely to encounter during anticipated use of the adapter.

A typical liquid dispenser may include for example, a sink, water pump, hose, or tap connected to a local, municipal, or wider area water supply. A typical liquid dispenser may also include a bottle, tank, barrel, or other liquid container. A liquid dispenser neck may include, therefore, a spout, a tap, nozzle, faucet, bottle mouth, or any other neck through which liquid may be dispensed from a liquid dispenser. A typical dispensed liquid includes water or any other dispensable potable or non-potable liquid.

The liquid inlet of a universal adapter typically includes a flexible material such as silicon that enables the liquid inlet to adapt to any of several types of liquid dispenser necks. The diameter or width of the outer wall of the adapter near the liquid inlet may be wide enough to accommodate, possibly with some stretching, the widest liquid dispenser neck for which the adapter is designed. Near the liquid inlet, the shape of the adapter wall is folded inward so as to form an inwardly sloping collar. The inwardly sloping collar slopes inward toward the liquid inlet opening formed by the inner edge of the inward sloping collar. The liquid inlet opening is typically circular, in order to accommodate liquid dispenser necks that are typically circular. However, other shapes may be possible in order to accommodate differently shaped liquid dispenser necks. The dimensions of the liquid inlet opening are such so as to enable the liquid inlet opening to fit over the narrowest liquid dispenser neck for which the adapter is designed with minimal gap between the opening and the neck.

The liquid inlet opening and inwardly sloping collar are designed so as to provide a seal between the universal adapter and a liquid dispenser neck when the universal adapter is in use. For example, when the dimensions of the liquid dispenser neck are small, the liquid dispenser neck may fit within the liquid inlet opening. On the other hand, the liquid dispenser neck may be wider than the liquid inlet opening. In this case, the end of the liquid dispenser neck may be partially inserted into, and press against, the inwardly sloping collar.

Once the liquid dispenser neck is inserted into the liquid inlet or inwardly sloping collar, liquid may be dispensed at an appropriate rate into the liquid inlet. The dispensed liquid may then fill the hollow body of the universal adapter. The pressure of the liquid in the hollow body may tend to press the inwardly sloping collar against the liquid dispenser neck. The pressure of the inwardly sloping collar against the liquid dispenser neck tends to provide a seal between the liquid inlet and the liquid dispenser. The provided seal may reduce or prevent leakage of liquid along the interface between the liquid inlet and the liquid dispenser.

As liquid flow is dispensed by the liquid dispenser, and depending on the type of liquid dispenser, it may be necessary to enable replacement of the volume of the dispensed liquid with air. For example, if the liquid dispenser is a rigid bottle, failure to replace the volume vacated by the dispensed liquid with air may decrease the pressure of the dispensed liquid. Reduction of the pressure of the dispensed liquid may impede the flow of dispensed liquid into the universal adapter.

A universal adapter in accordance with embodiments of the present invention is provided with a air inlet provided with a one-way valve. The air inlet includes an opening that extends from the outer surface of the universal adapter that faces the outside atmosphere, to the inner surface that faces the hollow interior of the universal adapter. Thus, the air inlet may enable air to flow into the hollow body of the universal adapter from the outside atmosphere. The one-way valve is designed to enable air to enter the hollow body but to prevent liquid from exiting. For example, the inner end of the air inlet may be covered with a one-way flap that is configured to enable air to flow inward through the air inlet, while preventing liquid from flowing outward through the air inlet. For example, the one-way flap may include a thin membrane or film with a surrounding structure that enables the flap to open inward but not outward. Thus, the flap may open inward when the liquid pressure is less then the ambient atmospheric air pressure. When the liquid pressure within the universal adapter is less than ambient pressure, the ambient pressure may force the flap to bend inward, enabling air to enter. On the other hand, when the liquid pressure within the universal adapter is greater than the ambient pressure, the liquid pressure forces the flap against the surrounding structure, preventing the liquid from leaking outward.

For example, a one-way cover in accordance with embodiments of the present invention may include an umbrella-shaped membranous flap. In this case, the opening of the air inlet may include a ring-like hub connected to the rim of the air inlet opening by spoke-like ribs. The handle of the umbrella shape may fit into, and be held in place by, the ring-like hub. The umbrella part of the umbrella shape includes a thin membranous flap that covers the entire inside of the air inlet opening and part of the surrounding area. The spoke-like ribs enable the membranous flap to bend inward toward the hollow interior of the universal adapter. However, the spoke-like ribs prevent the membranous flap from bending outward through the air inlet opening. Thus, inward pressure may enable air to flow inward through the air inlet. Outward pressure, on the other hand, may cause the membranous flap to press outward against the air inlet, completely covering and sealing the air inlet. Thus, the membranous flap prevents liquid from flowing outward from the universal adapter through the air inlet.

A liquid outlet of a universal adapter, in accordance of embodiments of the present invention, may be provided with a liquid outlet connector. The liquid outlet connector may be adapted for connection to a liquid intake hose or port of a liquid container. For example, the liquid container may be a flexible bladder of a hydration system. For example, the liquid outlet connector may be provided with appropriate fittings for attaching to corresponding fittings of a liquid intake hose or port. For example, the fittings may enable attachment of the liquid outlet connector of the universal adapter to a drinking hose of a hydration system.

Typically, the universal adapter is used to facilitate transfer of liquid from a liquid dispenser to a liquid container. When so used, the liquid inlet of the universal adapter is connected to an opening of the liquid dispenser, while the liquid outlet connector is connected to the intake of the liquid container to be filled. While transferring the liquid, the air inlet may enable air to enter the universal adapter to replace liquid that is emptied from the liquid dispenser. A barrier, such as, for example, an internal partition, may be positioned between the air inlet and the liquid outlet within the hollow interior of the universal adapter. The internal partition may direct flow of liquid or air bubbles from the air inlet away from the liquid outlet. Thus, the internal partition may inhibit or prevent air bubbles from being swept by the motion of the liquid into the liquid container being filled. Alternatively, the air inlet may be located nearer to the liquid inlet than to the liquid outlet such that flow toward the liquid inlet is more likely than flow toward the liquid outlet Inhibiting entry of air bubbles into the liquid container may enable more complete filling of the liquid container with a desired liquid.

When the liquid flows from the liquid dispenser under the force of gravity, the liquid may cease to flow when the liquid container is completely filled. The cessation in flow from the liquid dispenser may indicate to the user that the liquid container has been filled. When the liquid dispenser is pressurized, even when the liquid container is completely filled the liquid may continue to flow from the liquid dispenser neck into the liquid inlet of the universal adapter. Thus, the pressure of the liquid in the universal adapter may continue to increase. In this case, the pressure increase of the liquid in the universal adapter may force the adaptor flexible walls to expand outward and eventually push the liquid inlet away from the liquid dispenser neck. The expanding of the liquid inlet while pressure builds up may be detectable by the user, indicating that the liquid container has been filled.

Reference is now made to the accompanying Figures.

FIG. 1 is a perspective view of a universal adapter in accordance with some embodiments of the present invention, showing the liquid inlet. Universal adapter 10 includes adapter body 18. In some embodiments of the present invention, adapter body 18 is in the form of a flexible sleeve. For example, adapter body 18 may include synthetic or natural rubber, thermoplastic elastomer, or another similar flexible and impermeable material. When designed for use with a hydration system, a flexible material may be selected that does not tend to adversely affect the quality or flavor of the liquid. An end of adapter body 18 is shaped so as to form inwardly sloping collar 12. Inwardly sloping collar 12 slopes inward from rim 13 to liquid inlet opening 14. Diameters of inwardly sloping collar 12 and liquid inlet opening 14 may be selected so as to accommodate a desired range of liquid dispenser necks. A liquid dispenser neck may fit through liquid inlet opening 14, or may be pressed against inwardly sloping collar 12. Indented waist 17 and a ragged surface structure, such as gripping ribs 19, may assist a user in ensuring good contact between universal adapter 10 and a liquid dispenser neck. When adapter body 18 is filled with liquid, liquid pressure within adapter body 18 may press inwardly sloping collar 12 against the liquid dispenser neck, closing the space between inwardly sloping collar 12 and the liquid dispenser neck.

Figure 2:
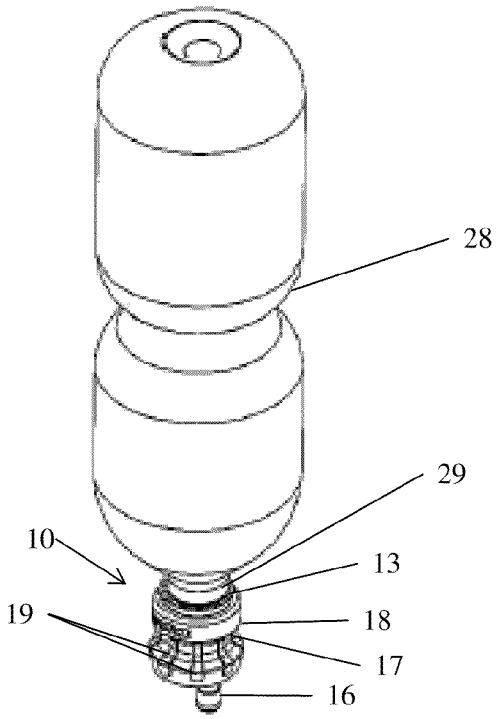
FIG. 2 shows a bottle coupled to the universal adapter shown in FIG. 1.

For example, the liquid dispenser may be a bottle. FIG. 2 shows a bottle coupled to the universal adapter shown in FIG. 1. As seen in FIG. 2, neck 29 of bottle 28 is inserted into the liquid inlet of universal adapter 10.

Figure 3:
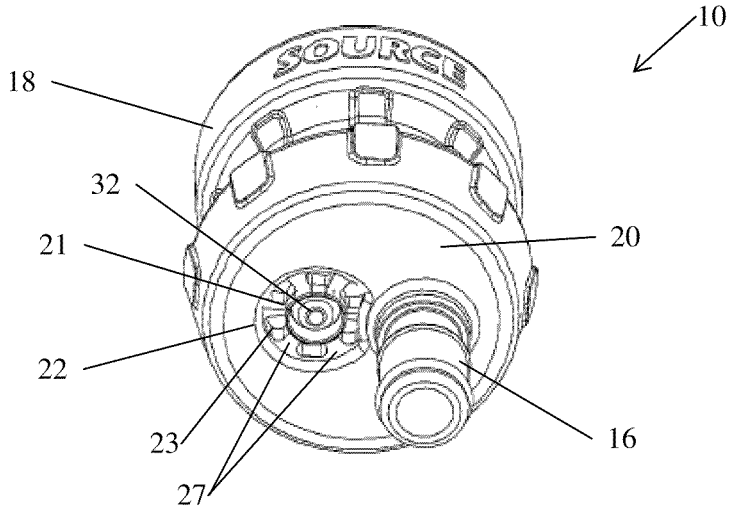
FIG. 3 is another perspective view of the universal adapter shown in FIG. 1, showing the air inlet and liquid outlet.
Figure 4:
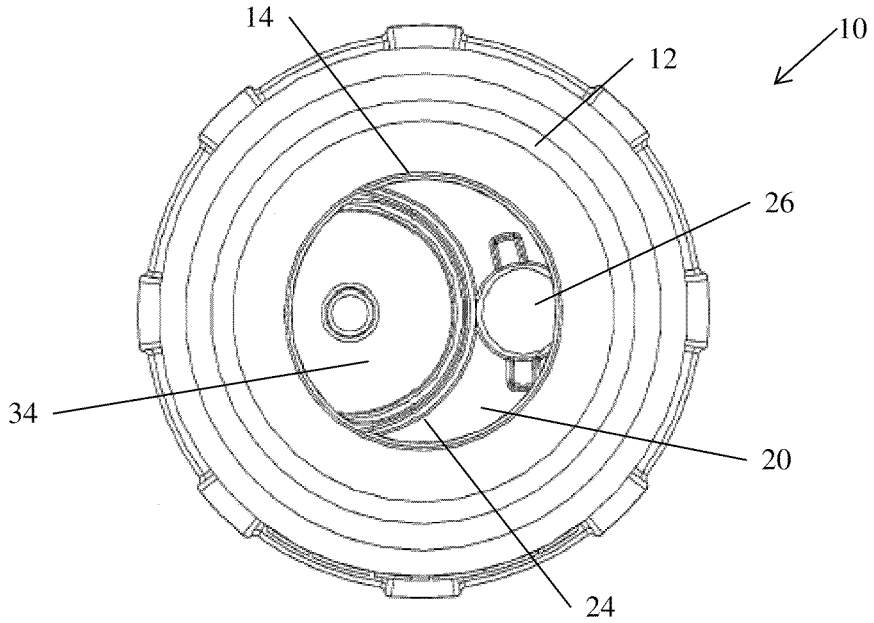
FIG. 4 shows a rigid plate of the universal adapter shown in FIG. 1 through the liquid inlet opening.

FIG. 3 is another perspective view of the universal adapter shown in FIG. 1, showing the air inlet and liquid outlet. FIG. 4 shows a rigid plate of the universal adapter shown in FIG. 1 through the liquid inlet opening. In some embodiments of the present invention, components of universal adapter 10 are located on rigid plate 20. For example, rigid plate 20 may include a rigid material such as a rigid plastic, metal, or ceramic material. For example, adapter body 18 may be in the form of a flexible sleeve that grips rim 25 of rigid plate 20, together forming structure of universal adapter 20.

In some embodiments of the present invention, rigid plate 20 may include liquid outlet 26 and air inlet 22. Liquid outlet 26 may be provided with connector 16. Connector 16 may be designed to couple to appropriately shaped corresponding connectors on a liquid container, or on a hose or other fixture connected to a liquid container.

Air inlet 22 is provided with a one-way valve that enables air to enter adapter body 18, but prevents liquid from exiting. One-way valves are known in the art. For example, air inlet 22 may be provided with a flapper valve that may open inward to enable air to enter, but not outward, preventing outward fluid flow. In a typical embodiment of the present invention, the flapper valve may include an umbrella shaped flexible flap that is designed to bend inward, but not outward.

Figure 5:
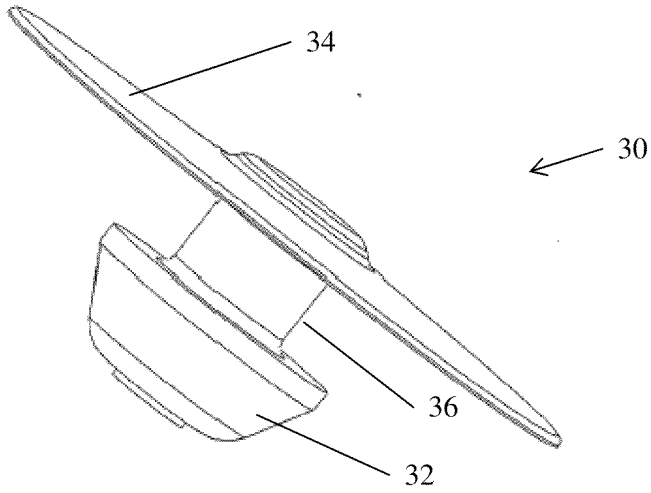
FIG. 5 shows an umbrella shaped one-way valve in accordance with some embodiments of the present invention.

FIG. 5 shows an umbrella shaped one-way valve in accordance with some embodiments of the present invention. Reference is also made to parts shown in FIG. 3, FIG. 4, FIG. 6A, and FIG. 6B. Air inlet 22 is provided with a central opening 21 surrounded by air openings 23 between spoke-like ribs 27. Valve anchor 32 of umbrella shaped one-way valve 30 fits through, and is held in place by, central opening 21. Umbrella-like flap 34 is connected to anchor 32 by stem 36. Umbrella-like flap 34 covers the entire interior opening of air inlet 22. The fluid pressure within adapter body 18 may fall below ambient pressure, for example, due to evacuation of liquid from a liquid dispenser. When the fluid pressure within adapter body 18 falls below ambient pressure, air may flow inward through air openings 23, causing umbrella-like flap 34 to bend inward. On the other hand, when fluid pressure within adapter body 18 is greater than ambient pressure the fluid pressure may push umbrella-like flap 34 outward. However, spoke-like ribs 27 and the area of rigid plate 20 surrounding air inlet 22 may prevent outward bending of umbrella-like flap 34. Thus, outward fluid pressure may tend to press umbrella-like flap 34 shut, sealing air inlet 22 to inhibit or prevent outward flow of fluid through air inlet 22.

Figure 6A:
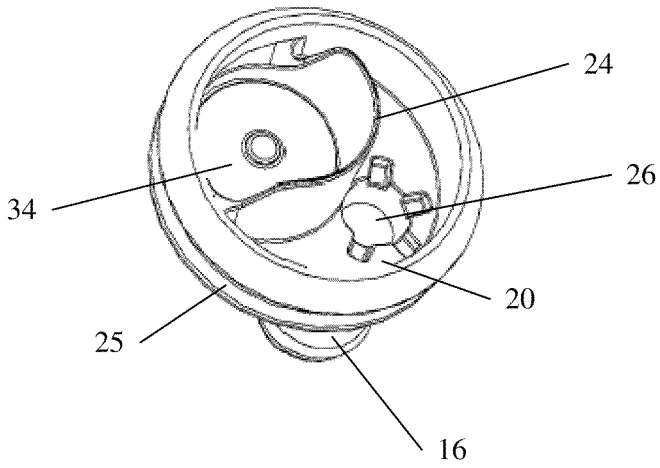
FIG. 6A shows the interior side of a rigid plate of the universal adapter shown in FIG. 1, including a one-way valve.
Figure 6B:
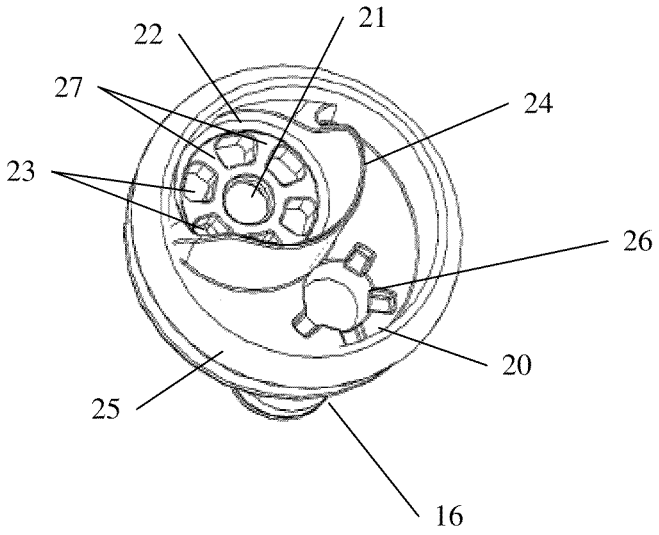
FIG. 6B shows the rigid plate shown in FIG. 6A without the one-way valve.

FIG. 6A shows the interior side of a rigid plate of the universal adapter shown in FIG. 1, including a one-way valve. FIG. 6B shows the rigid plate shown in FIG. 6A without the one-way valve. In the embodiment shown, air inlet 22 is located near liquid outlet 26 on rigid plate 20. In order to inhibit direct fluid flow, possibly including air bubbles, from air inlet 22 to liquid outlet 26, barrier 24 is located between air inlet 22 and liquid outlet 26. Bather 24 may thus direct fluid flow from air inlet 22 away from liquid outlet 26. Thus, barrier 24 may inhibit introduction of air bubbles via liquid outlet 26 into a liquid container attached to connector 16.

Thus, an adapter is provided that may attach to a range of sizes and forms of liquid dispenser necks and convey dispensed liquid to a container, that may facilitate dispensing of the liquid by enabling air to replace any volume vacated by the dispensed liquid, and that inhibits introduction of air bubbles into the liquid conveyed to the container.

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A universal adapter device for facilitating transfer of liquid from a neck of a liquid dispenser to a receiving container, the device comprising:

a hollow body that includes a flexible liquid inlet with an inwardly sloping flexible collar for adapting to the neck of the liquid dispenser;

a liquid outlet for connecting to an intake of the receiving container; and a one-way valve for allowing air from the ambient atmosphere into the hollow body when a pressure within the hollow body is less than ambient pressure, wherein when the liquid dispenser is pressurized, expanding of the flexible inlet due to a pressure build up in the universal adapter device is detectable by a user to indicate that the receiving container has been filled.

2. A device as claimed in claim 1, comprising a barrier between the one-way valve and the liquid outlet for directing air bubbles formed by air entering through the one-way valve away from the outlet.

3. A device as claimed in claim 1, comprising a connector for connecting the outlet to the receiving container.

4. A device as claimed in claim 1, wherein the one-way valve comprises a flapper valve.

5. A device as claimed in claim 4, wherein the flapper valve comprises an umbrella valve.

6. A device as claimed in claim 1, wherein the outlet and the one-way valve are located on a rigid plate, and wherein the hollow body is in the form of a flexible sleeve that grips the rigid plate.

7. A device as claimed in claim 1, wherein the hollow body includes a ragged outer surface.

8. A device as claimed in claim 7, wherein the ragged outer surface includes ribs.

9. A device as claimed in claim 1, wherein the hollow body includes an indented waist.

10. A device as claimed in claim 1, made from materials selected from the group of materials consisting of: synthetic rubber, natural rubber, and thermoplastic elastomer.

11. A device as claimed in claim 1, wherein the liquid inlet is circular.

* * * * *